United States Patent [19]

Klepsch

[11] 4,037,280

[45] July 26, 1977

[54] APPARATUS FOR WALKING ON WATER OR LAND

[76] Inventor: Christian Klepsch, Post Kirschberg, Haus, near 16, Doesingerried, Germany, 8371

[21] Appl. No.: 610,788

[22] Filed: Sept. 5, 1975

[30] Foreign Application Priority Data

Sept. 7, 1974 Germany ..... 2442948

[51] Int. Cl.[2] ..... A63C 15/04

[52] U.S. Cl. ..... 9/310 D

[58] Field of Search ..... 9/310 D

[56] References Cited

U.S. PATENT DOCUMENTS

| | | | |
|---|---|---|---|
| 2,651,790 | 9/1953 | Geiger | 9/310 D |
| 3,031,696 | 5/1962 | Brabb | 9/310 D |
| 3,621,500 | 11/1971 | Senghas | 9/310 D |
| 3,835,494 | 9/1974 | Dougherty | 9/310 D |

*Primary Examiner*—Trygve M. Blix
*Assistant Examiner*—Gregory W. O'Connor
*Attorney, Agent, or Firm*—W. G. Fasse; W. W. Roberts

[57] ABSTRACT

A pair of so called water shoes includes two members of mirror-symmetrical shape relative to a central, longitudinal plane. Each member or rather shoe includes a substantially vertically arranged floatation body for buoyancy and a substantially horizontally arranged floatation body for stabilization. The two floatation bodies of a shoe are connected to each other substantially at a right angle. In addition, each shoe is provided with paddles at least one of which operates as a standing foot when the shoes are used on land. The paddles are hinged to the underside, preferably of the horizontally extending floatation body so that they may flap into a retracted position when the particular shoe is pulled through the water in a forward direction and so that the paddles may increase the effective surface of the shoe when the latter is pushed in a rearward direction. The total buoyancy of each shoe may be variable relative to the weight of the person wearing the shoes.

13 Claims, 20 Drawing Figures

APPARATUS FOR WALKING ON WATER OR LAND

BACKGROUND OF THE INVENTION

The present invention relates to an apparatus for walking on water, or if desired on land. More specifically, the invention relates to a two component boat type device wherein the two components supplement each other to form a a pair of so called water shoes.

Means for traversing the surface of a body of water either in a gliding or in a walking manner are well known in the art. Basically, such devices comprise a small boat body for each foot of the wearer. In German Patent No. 38685 each shoe has the shape of a rectangular triangle merging into a semi-circle. German Patent No. 687047 discloses means for keeping the two water shoes more or less in parallel to each other when they are used. German Utility Model No, 188141 discloses water shoes, each of which is provided with a keel. U.S. Pat. No. 1,275,727 discloses a water shoe with a supporting plate and a keel. It is also known to provide water shoes made of foam material with small flexible fins.

The devices of the prior art generally have several drawbacks. Due to the length of the shoes they are hard to maneuver. Further auxiliary means may be required for locomotion. The normally required relatively wide spacing between the shoes makes it necessary for the wearer to stand on spread apart legs resulting in a heavy load on the legs and a consequent quick tiring. Moreover, a substantial skill is usually required on the part of the user to keep the shoes and thus the wearer himself in a balanced position. This is so because even if the wearer employs auxiliary means for locomotion such as a pushing stick or the like, the prior art shoes tend to run in different directions making the balancing rather difficult. Accordingly, prior art devices have mostly been used either by trained persons or by sports enthusiasts, a rather limited group as compared to the purchasing public at large.

Another disadvantage of prior art devices is seen in that the use of the arms or hands for handling auxiliary means of locomotion limits the use of such prior art water shoes in an undesirable manner. Thus, it is normally not possible to employ prior art shoes for fishing or performing other work on the water surface, for example, photographing or the like.

OBJECTS OF THE INVENTION

In view of the foregoing, it is the aim of the invention to achieve the following objects singly or in combination:

- to provide a pair of water shoes enabling the wearer to glide or walk on a water surface, whereby the two shoes forming a pair must permit the maintaining of a narrow spacing without any substantial effort on the part of the wearer so that walking will be possible without the use of auxiliary means of locomotion;
- to construct a pair of water shoes in such a manner that the wearer may freely negotiate curves while simultaneously having the free use of his arms and hands regardless whether he walks along a straight or curved path;
- each shoe of a pair shall have a sufficient buoyancy to support alone one person so that if necessary two persons may be transported, for example, in a rescue operation;
- to construct and shape the individual shoes of a pair of water shoes in such a manner that the wearer is enabled to use substantially a normal leg movement while simultaneously maintaining the close spacing between the two shoes of a pair;
- to assure a stable position of the shoes in the water at all times so that no particular skill and no auxiliary means are required for using the shoes and maintaining a balance;
- to provide each shoe with a paddle structure which will function as a standing foot when the shoes are used on land; and
- providing each shoe with two floatation bodies extending substantially at right angles to each other and the position of which is adjustable relative to each other in order to vary the buoyancy of the device, whereby merely a few different types need to be manufactured, while nevertheless satisfying the requirements of a wide range of persons of different weights and sizes.

SUMMARY OF THE INVENTION

The above objects have been achieved according to the invention in a pair of water shoes, each of which includes two floatation bodies. One floatation body extends substantially vertically forming a keel whereas the other extends substantially horizontally forming a stabilization member. The two floatation bodies are interconncted with each other substantially in a rectangular fashion whereby the interconnection may be accomplished either by merging the two bodies into each other along a border zone or by mechanically interconnecting two separate floatation bodies to each other. The latter embodiment has the advantage that by varying the elevational position of the floatation bodies relative to each other, the total buoyancy may be varied and thus adapted to the weight and size of the user. Each shoe is provided with at least one paddle structure which is hinged to the under surface of the shoe in such a manner that a forward gliding of the shoe in the water flaps the paddle structure backwardly to reduce the water resistance. The paddle structure extends automatically vertically in response to a rearward motion of the shoe to thereby increase the resistance against the pushing and thus facilitating the forward movement. The shoes are constructed substantially mirror-symmetrically relative to each other and relative to a central longitudinal plane, whereby the inner surfaces of the substantially vertically extending floatation bodies face each other. In a modification the volume of the floatation bodies may be varied, for example, by controlling the extent of inflation or the floatation bodies may be made of foam material, for example of the polyurethane or polystyrene variety. The construction of flexible rubber material is also possible, whereby preferably each floatation body is provided with several separate inflation chambers.

In the embodiment in which the two floatation bodies of a shoe merge into each other, as well as in the embodiment where two separate floatation bodies are interconnected by adjustable means, the cross section of a shoe may vary substantially. In other words, the cross section may on the one hand form an L-shape and on the other hand a triangular shape whereby the respective triangle may have equal or unequal legs. A foot rest is preferably arranged at the center of gravity of each shoe. The foot rest may be an indentation in the substantially vertically extending floatation body.

The above mentioned paddles are pivoted to the respective under surface of the vertically extending stabilization floatation body preferably for flapping through an angle of 90°, whereby a forward pull of the shoe flaps the paddle backwardly to therereby reduce the cross sectional surface area of the shoe, while a backward push of the shoe automatically extends the paddle surface into a substantially vertical position, thereby increasing the cross sectional surface of the respective shoe.

BRIEF FIGURE DESCRIPTION

In order that the invention may be clearly understood, it will now be described, by way of example with reference to the accompanying drawings, wherein.

Figure 1:
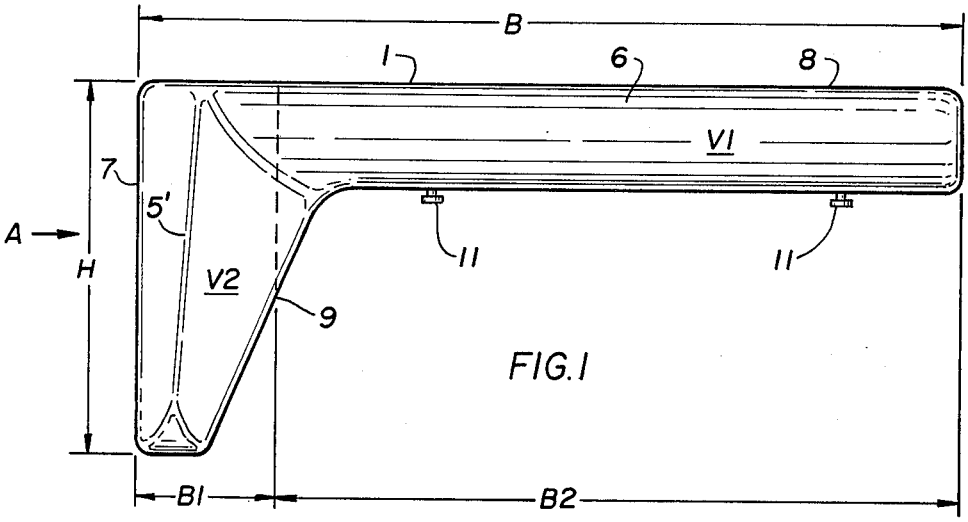
FIG. 1 is a front view of a left water shoe according to the invention.
Figure 3A:
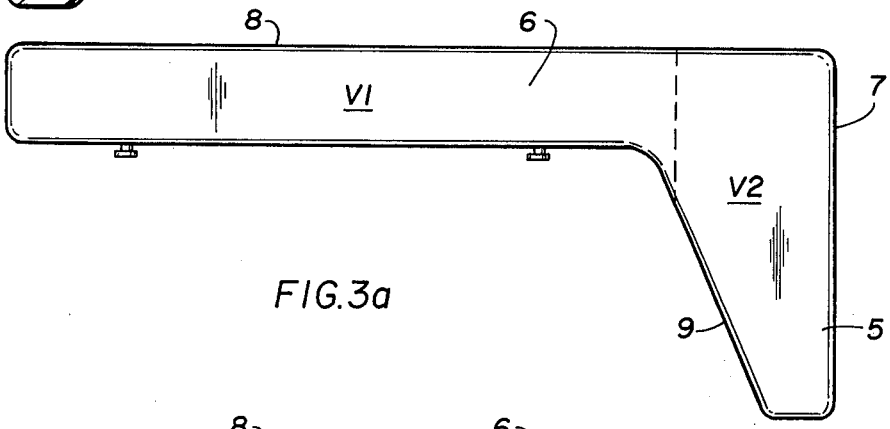
Figure 3B:
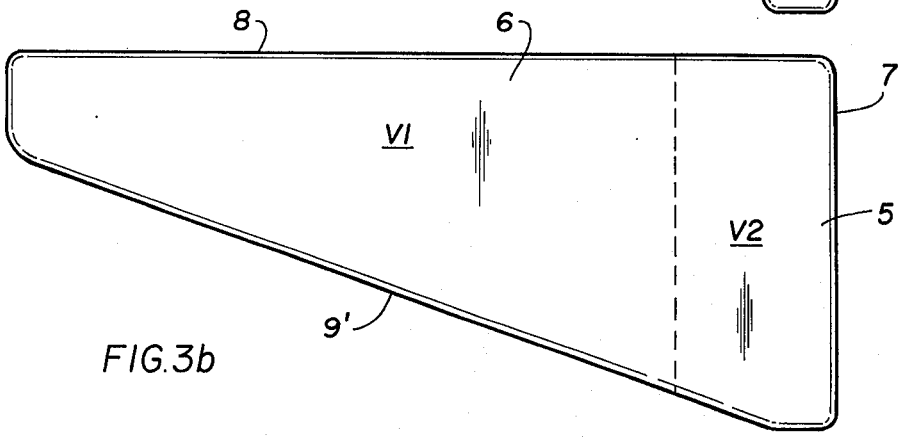
Figure 4:
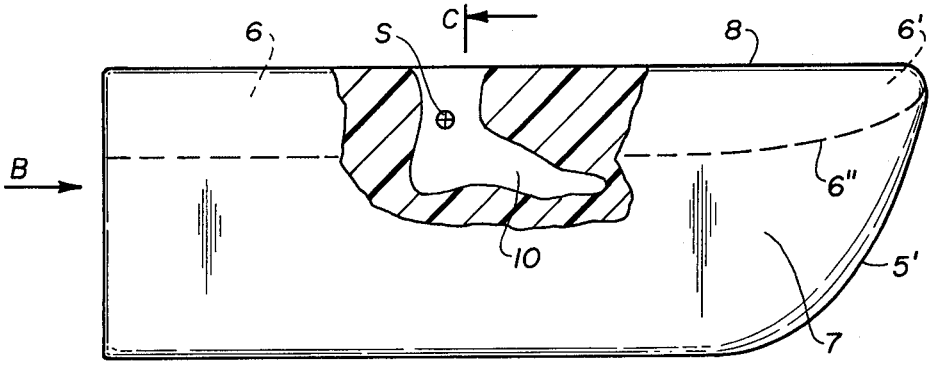
Figure 5:
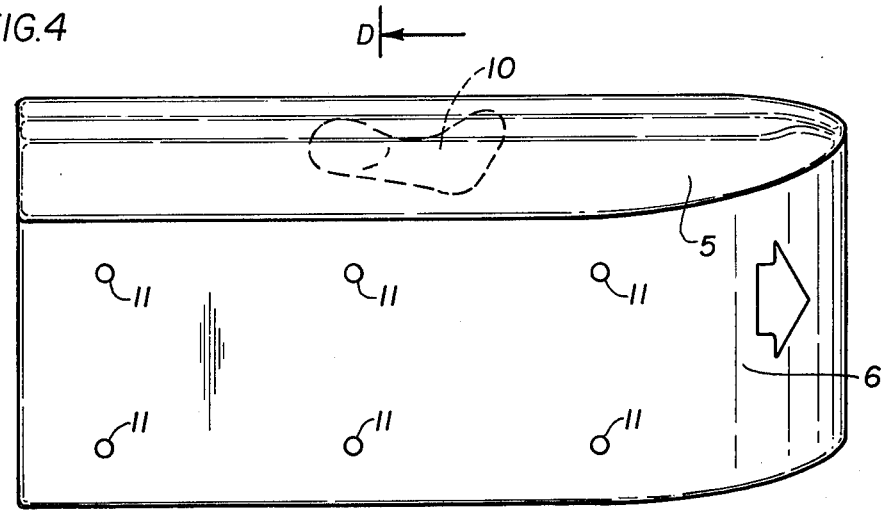
Figure 6:
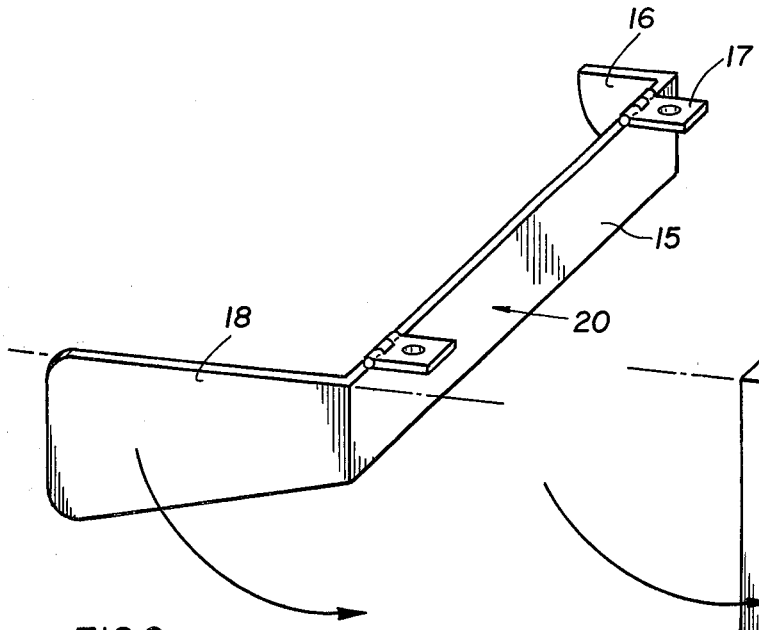
Figure 7:
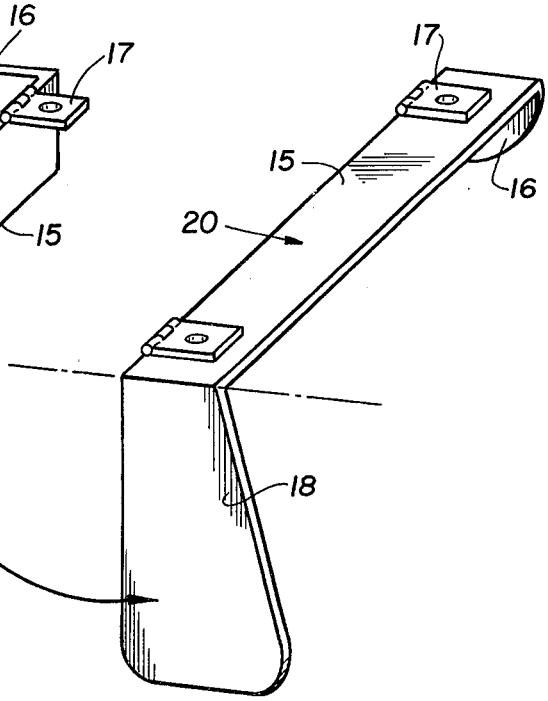
Figure 8:
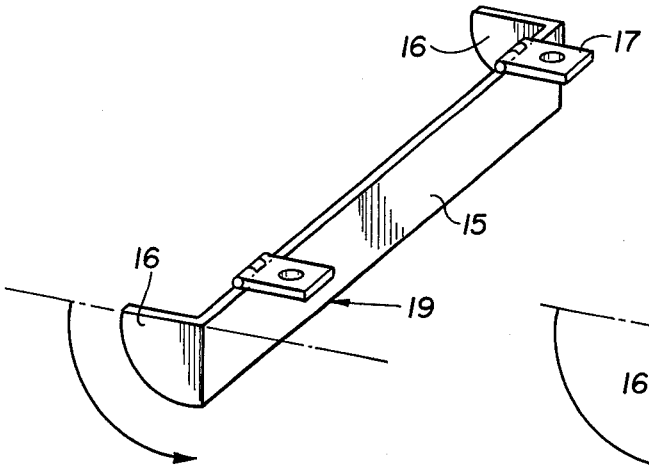
Figure 9:
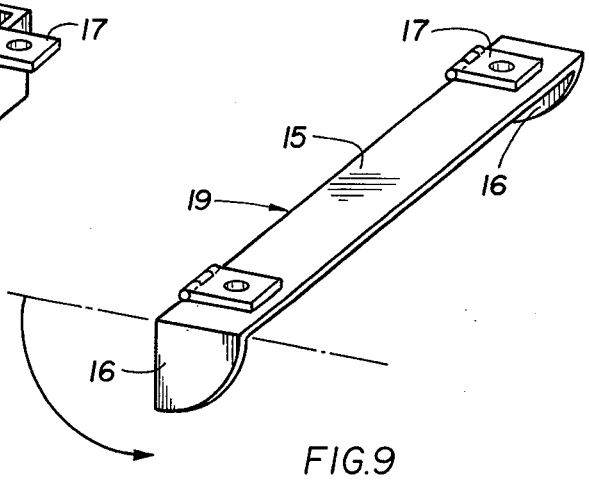
Figure 10:
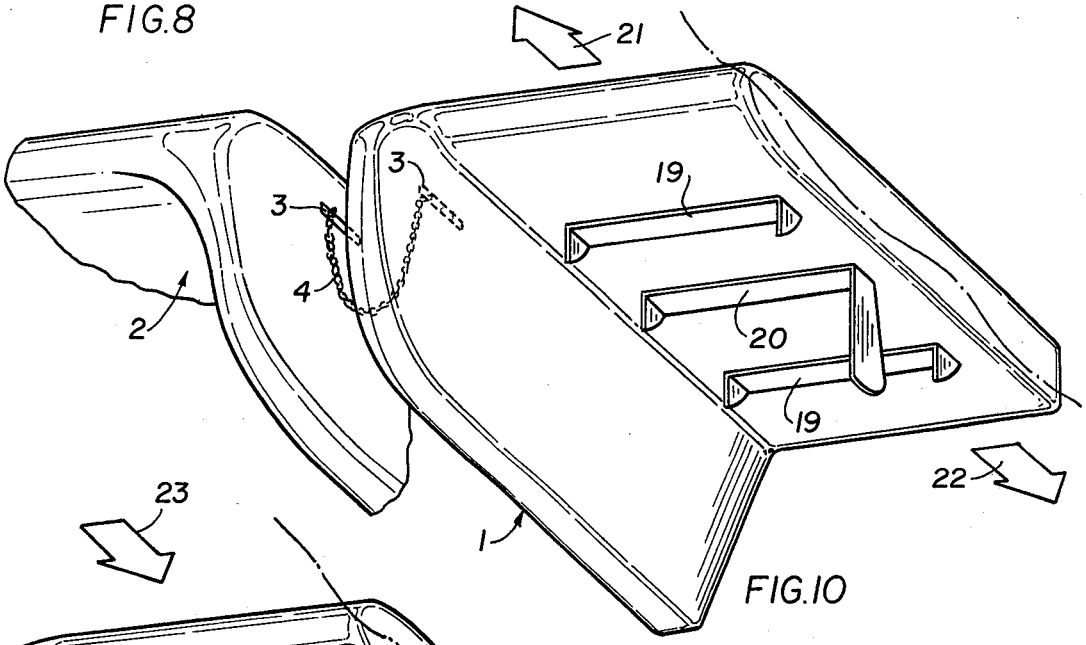
Figure 11:
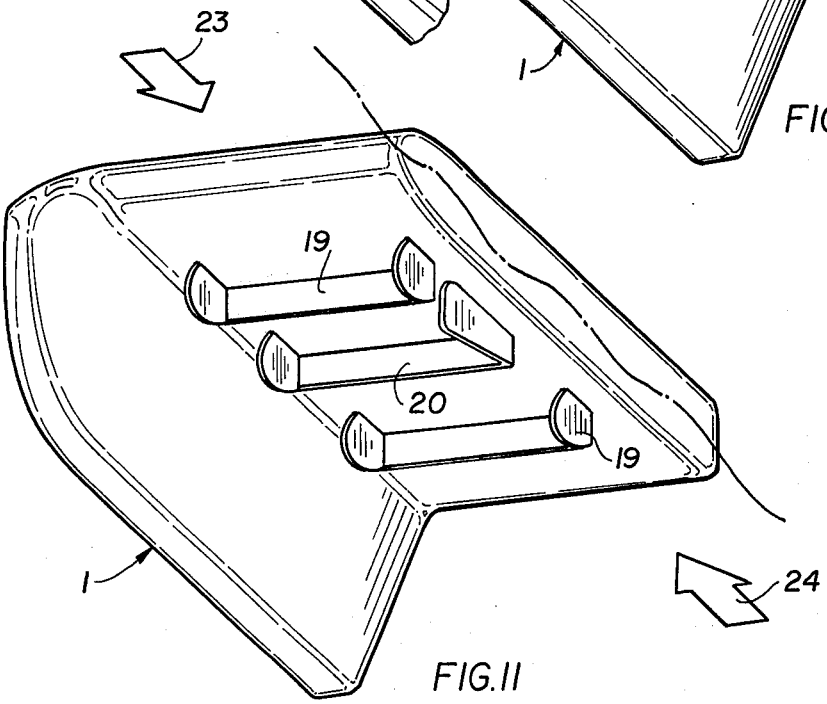
Figure 17:
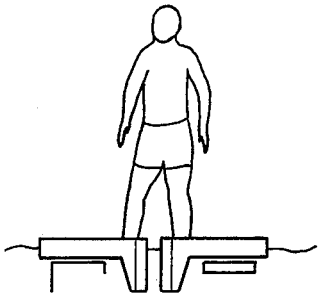
Figure 18:
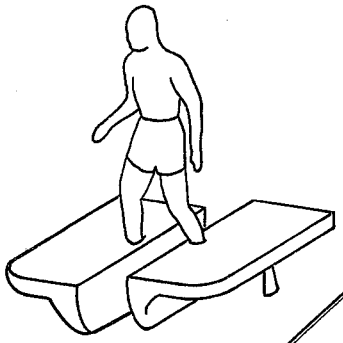
Figure 19:
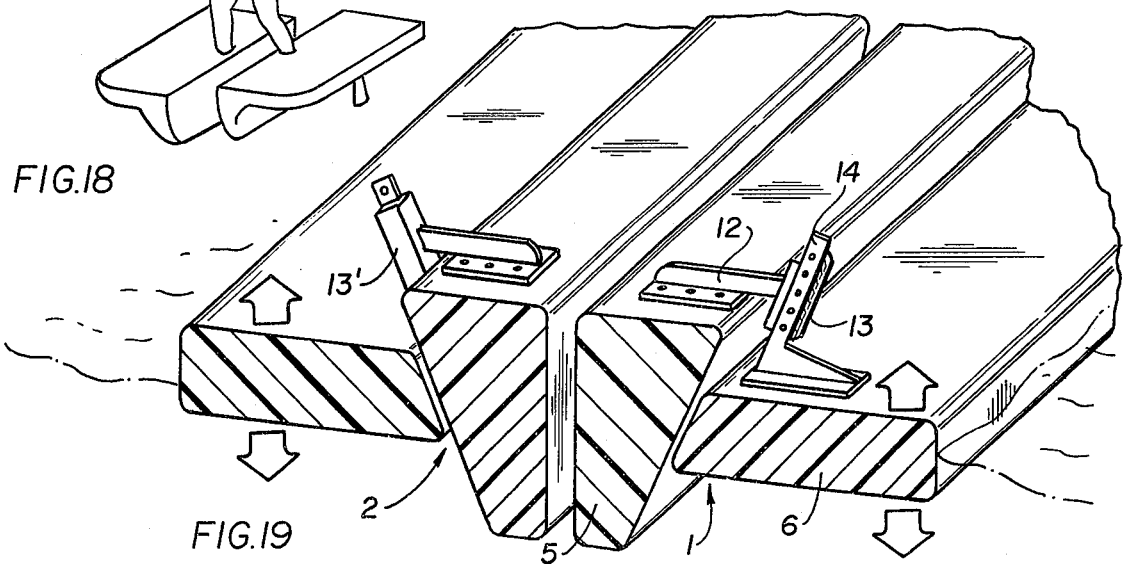

FIG. 3*a* is a rear view of the left shoe according to FIG. 1 in the direction of the arrow B shown in FIG. 4, FIG. 3*b* is a rear view similar to FIG. 3*a* and illustrates a modification of the water shoe according to the invention;

FIG. 4 shows a side view in the direction of the arrow A in FIG. 1 with a portion broken away to show the foot rest;

FIG. 5 illustrates a bottom view of a left shoe according to the invention with hinging points for push paddles, for examaple, three push paddles;

FIG. 6 illustrates one embodiment of a push paddle according to the invention in its position operative to increase the cross sectional area of the water shoe when it is pushed rearwardly;

FIG. 7 illustrates the paddle of FIG. 6 in its flapped back position, thereby reducing the cross sectional area of the water shoe when the latter is moved forwardly through the water or when the latter is used for walking on land;

FIG. 8 illustrates a modified paddle according to the invention in its surface increasing position;

FIG. 9 illustrates the paddle of FIG. 8 in its flapped back position;

FIG. 10 illustrates a perspective bottom view of a pair of shoes whereby the right shoe is shown merely partially and the left shoe is provided with three paddles according to the invention shown in their flapped back position;

FIG. 11 is a view similar to that of FIG. 10, however illustrating the paddles in their surface increasing position;

FIGS. 12 to 18 illustrate the use of the present water shoes in the various walking positions; and FIG. 19 illustrates a sectional view through a pair of water shoes according to the invention in which each shoe comprises two separate floatation bodies adjustably secured to each other.

DETAILED DESCRIPTION OF EXAMPLE EMBODIMENTS

FIG. 1 illustrates a front view of a left water shoe 1 according to the invention having a total width B and a height H. The total width is the sum of the width B1 of a substantially vertically arranged floatation body 5 and the width B2 of a substantially horizontally arranged floatation body 6. The vertical floatation body 5 forms a keel whereas the horizontal floatation body 6 forms a stabilization member. The body 5 has a volume V2 and the body 6 has a volume VI. These volumes V1 and V2 may form inflatable chambers, for example. The front end 5' of the keel 5 is tapered as shown. The top surface 8 of the shoe 1 extends substantially horizontally providing a substantial support area. The laterally and vertically extending side surface 7 of the shoe 1 faces the respective mirror-symmetrical surface of the right shoe, not shown. It will be noted that the surface 7 is plane and without any obstructions so that the two shoes may extend alongside each other with very little spacing. The bottom surface 9 of the shoe 1 has a shape so that the floatation bodies 5 and 6 substantially form an L. The bottom surface 9 of the shoe 1 is provided with connection means 11 such as screws, pivot members or the like for the connection of paddles to be described in more detail below. Incidentally, the tapering front end 5' facilitates the motion of the keel 5 through the water.

In the embodiment of FIG. 1 the two floatation bodies 5 and 6 are formed as an integral structure whereby the keel 5 merges integrally along a boundary zone into the stabilization body 6.

Figure 2:
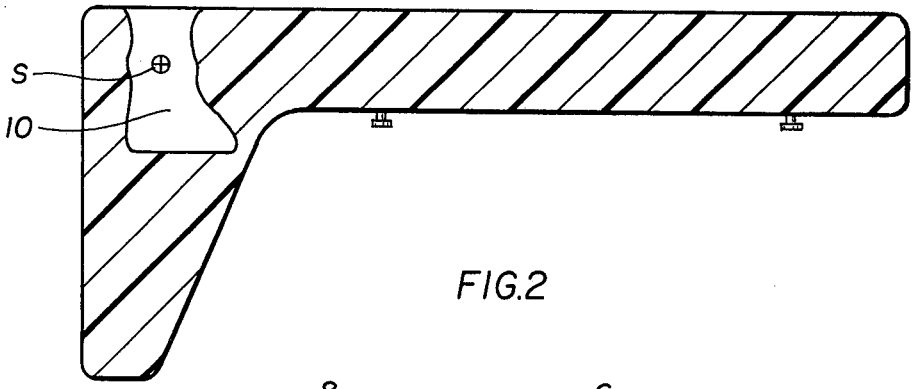
FIG. 2 is a sectional view through the shoe of FIG. 1 along the section line C–D in FIG. 4.

FIG. 2 illustrates a sectional view through the shoe 1 according to FIG. 1 along the section line C-D in FIG. 4. The center of gravity S is located in the upper left hand corner of the L-shaped water shoe and a foot rest 10 is arranged substantially in such a position that the center of gravity S is within the foot as shown.

FIG. 3 illustrates the rear view of the left shoe in the direction of the arrow B shown in FIG. 4, whereby again the straight surfaces 7 and 8 are emphasized.

In a modified embodiment also illustrated in FIG. 3, the bottom surface 9 may be replaced by a surface 9' illustrated in dashed lines and interconnecting the outer ends of the L-shape. The vertical dashed line again indicates the boundary zone between the keel 5 and the horizontal floatation body 6.

FIG. 4 is a side view of the shoe 1 according to FIG. 1, as viewed in the direction of the arrow A shown in FIG. 1. Parts are again broken away to illustrate the foot rest 10 located around the center of gravity S. The front edge 6' of the horizontally extending floatation body 6 may also be tapered as indicated by the right hand end of the dashed line 6'' in FIG. 4. The rear end of the shoe is preferably flat and extends vertically as shown in FIGS. 3 and 4, as well as 5.

FIG. 5 shows a bottom view of the left shoe with three connecting points 11 for paddles as illustrated in FIGS. 6, 7, 8 and 9, as well as 10 and 11. It is preferable to provide each shoe with three paddle structures. However, it would also be satisfactory to employ only one paddle structure for each shoe. The arrow in FIG. 5 indicates the forward motion of the shoe. The arrow in FIG. 5 indicates the forward motion of the shoe. It will be noted that the lower surface of the keel 5 is also relatively flat to provide a supporting surface when walking on land. The stability of this supporting surface of the keel is further increased by the paddle structure according to the invention as will be described in more detail below.

FIG. 6 illustrates one embodiment of a paddle structure according to the invention having a main portion 15, a rigid side flap 16 having for example, the shape of a quarter pie and a further rigid side flap 18 having for example, the shape of a center board, thus contributing to the stability and balancing of the present water shoes. Hinges 17 secure the paddle structure 15, more specifically, the main wall portion 15 of the paddle structure 20 to the pivot points 11, as shown, for example, in FIG. 5. FIG. 6 shows the paddle structure 20 in its operational position wherein the rigid side flaps extend alongside the under surface 9 of the horizontal floatation body 6, and wherein the surface of the portion 15 extends at right angles to the floatation body thereby increasing the sectional surface of the shoe and thus making the paddle effective to resist a backward push.

FIG. 7 illustrates the paddle of FIG. 6 in its retracted position, whereby the surface portion 15 rests substantially flat against the bottom surface of the floatation body 6, thereby reducing the cross sectional surface and facilitating the forward pulling motion of the shoe. In this position the rigid side flaps 16 and 18 extend substantially verticaly downwardly whereby especially the side flap 18 provides a standing foot for the shoe which in combination with the bottom surface of the keel increases the standing stability of the entire water shoe structure. The hinge arrangement 17 is such that the forward pull of a shoe automatically brings the paddle structure into the inoperative position, whereas the backward push automatically brings the paddle structure into the operative position. In order to utilize the side flap 18 as a standing foot, it is preferable to arrange the paddle structure of FIGS. 6 and 7 centrally of the water shoe as best seen in FIG. 10.

FIGS. 8 and 9 show a modified paddle structure similar to that of FIGS. 6 and 7, whereby again FIG. 8 illustrates the surface increasing position, whereas FIG. 9 illustrates the surface decreasing position of the paddle structure. The modification resides in the fact that both rigid side flaps 16 are of the same shape, namely, a quarter pie section. The paddle structure of FIGS. 8 and 9 is preferably arranged in front of and back of the paddle structure of FIGS. 6 and 7 again as best seen in FIG. 10.

Referring to the respective view of FIG. 10 there is shown the underside of the left show 1 and a portion of the underside of the right shoe 2. The two shoes are interconnected with each other by a chain 4, the ends of which may be slidably and releasably locked in respective slots 3, for example, in the manner of door chains. The chain 4 or any other flexible member such as a rubber strip or the like has preferably a length corresponding to about 1.5 times the length of an average pace. The slots 3 are arranged in the side surfaces 7 of the shoes 1, 2. In the position shown in FIG. 10 the paddle structures are shown in their neutral position because the shoe moves forward in the direction of the arrow 21, while the water pressure 22 keeps the paddle structures in the retracted, surface decreasing position to facilitate the forward movement of the shoe.

In FIG. 11 the left shoe shown is in the stopped position, whereas the right shoe not shown is moved forward. In this condition, the water pressure 22 constituting the reacting force against the pressure 23 of the shoe places the paddle structures into the operative position tilted by 90° relative to the position shown in FIG. 10. This condition is maintained as long as the shoe is relatively stationary and changed back to the condition shown in FIG. 10 when the shoe moves again fowardly.

Figure 12:
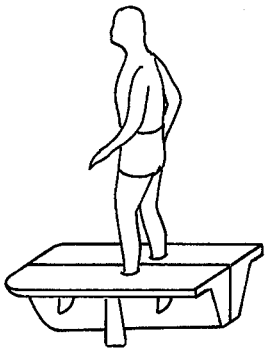
Figure 13:
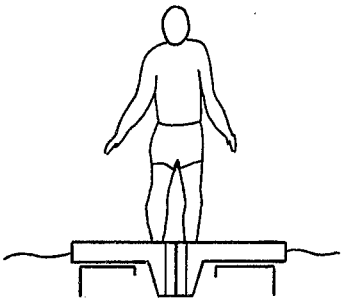

FIG. 12 illustrates a perspective side view in which the user holds his legs in the normal side by side position. This may correspond to a rest position. In FIG. 13 the same position is illustrated as a front view. In this position the paddle structures will substantially extend to minimize the cross sectional surface of the shoes, whereby the side flaps 20 will extend straight down to form standing feet as shown.

Figure 14:
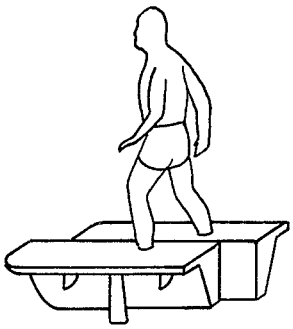
Figure 15:
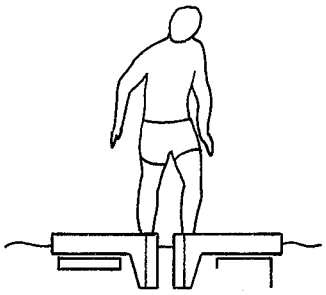

In FIG. 14 the user has moved his left leg forward and his right leg is in the counteraction position. Thus, the front view of FIG. 15 shows the surface increased position of the paddle structure of the right shoe and the surface decreasing position of the paddle structure of the left shoe.

Figure 16:
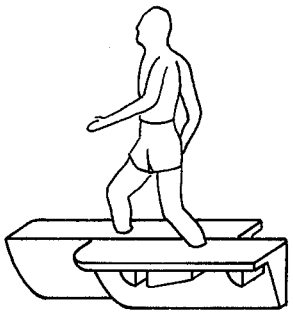

In FIGS. 16 and 17 the situation is reversed. In other words, the user keeps his left leg in the rest or counteracting position, and moves his right leg forwardly.

Contrary to FIGS. 12 and 17 illustrating the movement in water, FIG. 18 illustrates the movement on land, whereby the side flaps 20 constitute standing feet cooperating with the lower surface of the keel as described. Assuming a normally uneven land surface the structure provides a three point support for each shoe.

FIG. 19 illustrates a sectional view through a shoe structure according to the invention in which each shoe 1 and 2 comprises two separate floatation bodies 5 and 6 secured to each other by adjustable connecting means 12, 13 and 14. The connecting member 12 secured to the floatation body 5 may, for example, comprise a hollow channel 13 with a hole 13' extending across the channel. The connecting member 14 secured to the floatation body 6 includes a plurality of apertures which may be aligned with the hole 13' and the connection may be accomplished by a cotter pin or the like. Thus, the connection may be easily disassembled, for example, for transporting the water shoes in the trunk of a car.

By adjusting the elevational position of the floatation bodies 5 and 6 relative to each other in accordance with the spacings between the holes in the connecting member 14 it is possible to increase or decrease the buoyancy of the entire structure in accordance with the steps defined by the spacings between adjacent holes.

The floatation bodies 5 and 6 are preferably made of a hydrophobic light material, for example, a polyurethane foam material or a styrofoam material. Alternatively, the floatation bodies may be made of rubber with inflatable chambers, whereby preferably a plurality of chambers are provided in each body. In any event, the rubber material should be sufficiently elastic to permit an increasing of the inflated volume to about 1.5 times the uninflated volume. Thus, as in the embodiment of FIG. 19, the buoyancy is easily adapted to the weight of the user.

Regarding the dimensions of the present water shoes it has been found to be advantageous to maintain certain relationships. Thus, the total width B as illustrated in FIG. 1, which is the sum of the widths of the individual floatation bodies 5 and 6 ($B = B1 + B2$) should not be wider than twice the height H. In other words, H should correspond to about 0.5 times B. The length L should correspond to about 1.7 times the width B and the width B1 of the keel 5 should amount to about 0.5 of the total width whereas the width B2 of the stabilization body 6 should correspond to about 0.8 of the total width B. In addition, the total width B should taper in the forward direction and over the length of the water shoe by about 3 to 10%, whereby the cross sectional area should remain substantially constant over the length of the shoe except for said tapering. In addition, it has been found that the preferable relation between the volumes V1 and V2 should be about 50 to 50. However, suitable variations may be made within the range of 60 to 40 to 40 to 60.

In a practical embodiment in which each shoe provides sufficient buoyancy to support about 150 kgs. and in which the shoes were made of polyurethane foam the average width B1 of the keel floatation body 5 was 150 mm. The average width B2 of the stabilization floatation body 6 was 600 mm resulting in a total width B of 750 mm. In accordance with the above given relationships the height of the shoes was 370 mm. Each of the volumes V1, V2 was about 80 liters, resulting in a total volume of about 160 liters and a volume ratio of 1 to 1.

Incidentally, the connecting means 11 could, for example, be provided in the form of snap buttons or the like facilitating an easy disassembly of the structure.

Summarizing, it has been found that the present water shoes provide a substantial stability in the water, as well as on land, so that they may be used without any particular skill. Moreover, the present shoes may not only be used for recreational purposes, as by fishermen or the like, but also for performing practical work on the water surface, for example, in connection with construction in and alongside of bodies of water.

Although the invention has been described with reference to specific example embodiments, it is to be understood, that it is intended to cover all modifications and equivalents within the scope of the appended claims.

What is claimed is:

1. An apparatus or walking on water or land, comprising floatation means, each floatation means including a substantially vertically arranged floatation body forming a keel and a substantially horizontally arranged floatation body forming a stabilization member, means operatively interconnecting said floatation bodies to each other so that two floatation means forming a pair have a mirror symmetrical shape relative to each other whereby each of the respective vertically arranged floatation bodies has a vertical surface and the vertical surfaces of the pair face each other to extend substantially in parallel to each other when the pair is in use, said apparatus further comprising paddle means, and means operatively securing said paddle means to said floatation means whereby said paddle means normally extend downwardly but flap backwardly when the respective floatation means is pulled through the water, and wherein said paddle means comprise at least one paddle structure including a first portion and a second portion extending substantially at a right angle to said first portion, said first and second paddle portions being rigidly connected to each other to form said paddle structure, said securing means hinging said first portion to said substantially horizontal floatation body whereby said second paddle portion performs a stabilizing function.

2. The apparatus according to claim 1, wherein said interconnecting means comprise a boundary portion in each of said floatation bodies, said boundary portions merging into each other to form an integral structure.

3. The apparatus according to claim 1, wherein said interconnecting means comprise separate elements secured to said vertical floatation body and to said horizontal floatation body, said elements comprising adjustable means for securing said substantially horizontal floatation body to said substantially vertical floatation body at different elevations relative to each other.

4. The apparatus according to claim 1, further comprising foot rest means located substantially at the center of gravity of each floatation means.

5. The apparatus according to claim 1, wherein each floatation means comprises a total width B, a height H, and a length L, said substantially vertically arranged floatation body having a width B1, said substantially horizontally arranged floatation body having a width B2, whereby $B = B1 + B2$, said height H corresponding to about $H \approx 0.5B$; said length L corresponding to about $L \approx 1.7B$; said width B1 corresponding to about $B1 \approx 0.2B$; said width B2 corresponding to about $B2 \approx 0.8B$; wherein said total width B diminishes over the length of said floation means by about 3 to 10% in the forward direction for tapering said floatation means in the forward direction, and wherein said floatation bodies have volumina V1 and V2 which may vary relative to each other within the range of V1 to V2 $\approx$ 40 to 60 and vice versa.

6. The apparatus according to claim 5, wherein V1 to V2 corresponds to 50 to 50.

7. The apparatus according to claim 1, wherein each floatation means comprises at least three paddle structures, said securing means hinging said paddle structures to the respective floatation means so that the paddle structures may flap backwardly in response to a forward pulling motion of the respective floatation means and may provide an increased body surface in response to a backward pushing motion.

8. The apparatus according to claim 1, wherein each floatation body is capable of alone supporting the weight of a wearer.

9. The apparatus according to claim 1, wherein said floatation bodies are made of buoyant foam material.

10. The apparatus according to claim 1, wherein said floatation bodies are constructed as inflatable chambers.

11. The apparatus according to claim 10, wherein said inflatable chambers are made of rubber which is sufficiently elastic to permit a volume increase of at least 50% as compared to the uninflated volume.

12. The apparatus according to claim 1, further comprising flexible means interconnecting two floatation means to form a pair.

13. The apparatus according to claim 12, wherein said flexible means comprise a chain having a free length corresponding to about 1.5 times the length of an average pace.

* * * * *